US011918055B2

(12) United States Patent
Paterson

(10) Patent No.: US 11,918,055 B2
(45) Date of Patent: Mar. 5, 2024

(54) PIPE SNUFFER AND METHOD

(71) Applicant: John Paterson, Washoe City, NV (US)

(72) Inventor: John Paterson, Washoe City, NV (US)

( * ) Notice: Subject to any disclaimer, the term of this patent is extended or adjusted under 35 U.S.C. 154(b) by 0 days.

(21) Appl. No.: 18/125,096

(22) Filed: Mar. 22, 2023

(65) Prior Publication Data

US 2023/0301346 A1 Sep. 28, 2023

Related U.S. Application Data

(60) Provisional application No. 63/322,479, filed on Mar. 22, 2022.

(51) Int. Cl.

| | |
|---|---|
| ***A24F 13/18*** | (2006.01) |
| ***A24F 9/00*** | (2006.01) |
| ***A24F 5/00*** | (2006.01) |
| ***A24F 1/00*** | (2006.01) |

(52) U.S. Cl.

CPC ..... *A24F 9/00* (2013.01); *A24F 1/00* (2013.01); *A24F 5/00* (2013.01); *A24F 13/18* (2013.01)

(58) Field of Classification Search

None

See application file for complete search history.

(56) References Cited

U.S. PATENT DOCUMENTS

| | | | | |
|---|---|---|---|---|
| 2,335,497 | A * | 11/1943 | Ehrsam | B23P 15/40 30/142 |
| D154,736 | S | 8/1949 | Aronowitz | |
| D204,116 | S | 3/1966 | Raffles | |
| D760,951 | S | 7/2016 | Bennett | |
| 2007/0261709 | A1* | 11/2007 | Bakus | A45D 44/00 132/214 |
| 2012/0234341 | A1* | 9/2012 | Kingery | A45D 27/42 132/214 |
| 2013/0213429 | A1* | 8/2013 | Allen | A45D 24/36 132/214 |
| 2015/0342251 | A1* | 12/2015 | Beecher et al. | A24F 9/00 131/256 |
| 2015/0351453 | A1 | 12/2015 | Cruz | |
| 2016/0345623 | A1 | 12/2016 | Pearson, Jr. et al. | |
| 2017/0049148 | A1 | 2/2017 | Murphy | |
| 2017/0150752 | A1 | 6/2017 | Healy et al. | |
| 2019/0014816 | A1 | 1/2019 | Crosby | |
| 2019/0239560 | A1 | 8/2019 | Flynn | |

FOREIGN PATENT DOCUMENTS

| | | |
|---|---|---|
| GB | 652158 | 4/1951 |
| WO | WO 2021/022164 A1 | 2/2021 |

* cited by examiner

*Primary Examiner* — Dionne W. Mayes

(74) *Attorney, Agent, or Firm* — John D. Long, Esq.; LONG & CHYBIK

(57) ABSTRACT

The invention is a smoking pipe snuffer and method of operation, the smoking pipe snuffer comprising a heat resistant flexible sheet cut in the shape of an inverted L to denote a foot portion connected to a leg portion, the foot portion is further configured to be removably placed over a smoking pipe's large bowl aperture to removably seal the large bowl aperture and protect a portion of the operator's thumb placed over the flexible sheet from any heat emission from a hollow bowl interior; and the leg portion is further configured to be removably secured between a stem of the smoking pipe and thenar portion of the operator's thumb.

13 Claims, 5 Drawing Sheets

PIPE SNUFFER AND METHOD

CROSS-REFERENCES TO RELATED APPLICATIONS

Not Applicable.

STATEMENT REGARDING FEDERALLY SPONSORED RESEARCH OR DEVELOPMENT

Not Applicable

REFERENCE TO A "MICROFICHE APPENDIX"

Not Applicable.

Field of the Invention

The present invention may relate to smoking pipe snuffers and their methods of operation. More particularity to those smoking pipe snuffers that may apply a pliable sheet over the pipe bowl's large aperture and further lays said pliable sheet upon at least a portion of the pipe stem.

Background

Smoking pipes may be seen as devices used to hold a smokable substance that is burned with the resultant smoke being inhaled by a smoke pipe operator. The smokable substances may include tobacco, marijuana and the like. As substantially shown in FIG. 1, a smoking pipe 10 may comprise a pipe bowl 12 and pipe stem 14, wherein the pipe bowl 12 may further define a 25 large bowl aperture 16, a stem bowl aperture 18 and a hollow bowl interior 20 with all three said spaces substantially being continuously connected. The pipe stem 14 may have a tubular construction that may further define a double open-ended longitudinal midline pipe stem channel 22. One open channel end 24 may be removably connected to the stem bowl aperture 18 to removably connect the pipe bowl 12 to the pipe stem 14. In this manner, the hollow bowl interior 20 is removably and continuously connected to the double open-ended longitudinal midline pipe stem channel 22. The other open channel end 26 may be accessed by the operator's mouth 30 to draw air in through the smoking pipe 10 by way of the large bowl aperture 16.

An amount or plug of smoking or smokable material or substance 28 may be placed into the hollow bowl interior 20 through the large bowl aperture 16. This amount of smoking substance 28 then be contacted with an open flame source 32 (e.g., as generally provided by a lit match, lighter or the like) to ignite the smoking substance 28. At the same time, the operator may draw down on the pipe stem 14 by sucking on the other open channel end 26 generally located on the pipe stem 14 away from the pipe bowl 12 to create a draft over the ignited smoking substance 28. This draft action could create a momentary vacuum in the hollow bowl interior 20 wherein the burning smoking substance 28 could receive additional air 36 (e.g., atmospheric oxygen) that further fuels the smoking substance combustion. The combustion then could release substance smoke 34 to be brought by operator-created draft though the pipe stem channel 22, out of the other open channel end 26 and into the operator's mouth 30. Once the operator has breathed in the said substance smoke 34, the operator could then exhale the substance smoke 34. This smoking action could be repeated as desired by the operator.

Upon finishing the smoking activity, the ignited smoking substance may be left in the bowl to burn or may be otherwise extinguished. A pipe operator may wish to extinguish the ignited smoking substance (especially expensive smoking material such as marijuana) in the bowl to preserve the remaining unburnt smoking substance for future use. Extinguishing the ignited substance may be done by covering the large bowl aperture or otherwise covering the unburnt portion of the substance within the pipe bowl (e.g., to generally prevent a draw of air across the ignited smoking substance.) A removeable pipe extinguishment device or pipe snuffer may be placed over the large bowl aperture (e.g., snuffer) to generally seal the large bowl aperture or the said device (e.g., a stopper) may be inserted into the hollow bowl interior to generally cover over the ignited smoking substance. With the large bowl aperture removably sealed, the air coming in from the pipe stem's other open end could be insufficient to maintain the burning of the smoking substance.

One possible issue with such pipe extinguishment devices and methods, that they could rely upon the operator's thumb as used for snuffing operations. In placing an operator's thumb over burning material contained in the pipe bowl when operating various snuffing devices, the operator's thumb could be heated enough to be burned.

SUMMARY OF ONE EMBODIMENT OF THE INVENTION

Brief Description of One Embodiment of the Present Invention

What could be needed to resolve such issues may be the present invention that substantially comprises a pliable and heat resistant sheet generally have inverted L-shape forming a wide foot portion continuously connected to a narrower leg portion. The operator could removably apply this sheet to an active smoking pipe by grasping the pipe stem with the curled fingers of one hand and further holding the leg portion in between a top of the pipe stem and a bottom of the thumb's rear portion. The bottom of the thumb tip could then press down the wide or foot portion of the invention over the pipe bowl to substantially and removably seal the wide bowl aperture to generally snuff out any ignited smoking material as located within the hollow bowl interior thereby preserving the unburned portion of the smokable substance for later use.

One possible embodiment of the invention could be a smoking pipe snuffer that may comprise a heat resistant flexible sheet cut in the shape of an inverted L to denote a foot portion that is wider than a connecting leg portion, the foot portion is configured to be removably placed over a pipe bowl's large bowl aperture to removably seal the large aperture and protect the operator's thumb from heat emission while the leg portion to be configured to be removably secured between a stem of the smoking pipe and an operator's hand, namely a thumb's rear portion that may also be known as thenar region or eminence.

Another possible embodiment of the invention could be a combination of a smoking pipe snuffer and a smoking pipe may comprise a smoking pipe having a pipe bowl connected to a pipe stem, the pipe bowl forming a hollow bowl interior continuously connected to a large bowl aperture and pipe stem aperture, the pipe stem further forming a doubled open-ended channel wherein one open end of the pipe stem is received within the stem aperture to continuously connect the double open-ended channel with the hollow bowl interior; a smoking pipe snuffer having a heat-resistant flexible sheet cut in the shape of an inverted-L to denote a foot portion and a leg portion, the foot portion is configured to be placed over the large bowl aperture to removably seal the pipe bowl aperture and a leg portion being configured to be removably secured upon the pipe stem, wherein a rear portion of operator's hand, namely a thenar region or eminence removably holds the leg portion upon at least a portion of a pip stem's topside, wherein the front thumb portion removably holds the foot portion over the top of the pipe bowl to removably seal the bowl large aperture.

Yet another possible embodiment could be a method of operating a smoking pipe snuffer, comprising of the following steps, first providing a smoking pipe having a pipe bowl connected to a pipe stem, the pipe bowl forming a hollow bowl interior continuously connected to a large bowl aperture and pipe stem aperture, the pipe stem further forming a doubled open-ended channel wherein one open end of the pipe stem is received within the stem aperture to continuously connect the double open-ended channel with the hollow bowl interior; providing a smoking pipe snuffer having a heat-resistant flexible sheet cut in the shape of an inverted-L to denote a foot portion and a leg portion, the foot portion is configured to be placed over the large bowl aperture to removably seal the pipe bowl aperture and a leg portion being configured to be removably secured upon the pipe stem, grasping the pipe stem with the curled fingers of one hand of the operator and holding the leg portion between a top of the pipe stem and a bottom of the thumb of the one hand wherein a first digit portion of the said thumb further pressing down upon the foot portion of the invention onto bowl and removably sealing the large aperture wherein a thenar region of said thumb further presses down upon the leg portion removably securing the leg portion upon the top pipe stem.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

Advantages of One or More Embodiments of the Present Invention

The various embodiments of the present invention may, but do not necessarily, achieve one or more of the following advantages:

- to provide a contoured flexible sheet to extinguish smokable material such as marijuana, tobacco or the like in a smoking pipe while substantially using an operator's thumb to seal the pipe bowl's large aperture with the contoured flexible sheet;
- the ability to protect an operator's thumb from burning during the extinguishment of a burning smokable substance held in a smoking pipe bowl;
- provide a pipe snuffer that is removably secured in between a pipe stem and operator's thumb (e.g., the thumb's thenar region or eminence); and
- the ability to use an operator's thumb to hold in place and operate a sheet-based pipe bowl snuffer.

These and other advantages may be realized by reference to the remaining portions of the specification, claims, and abstract.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
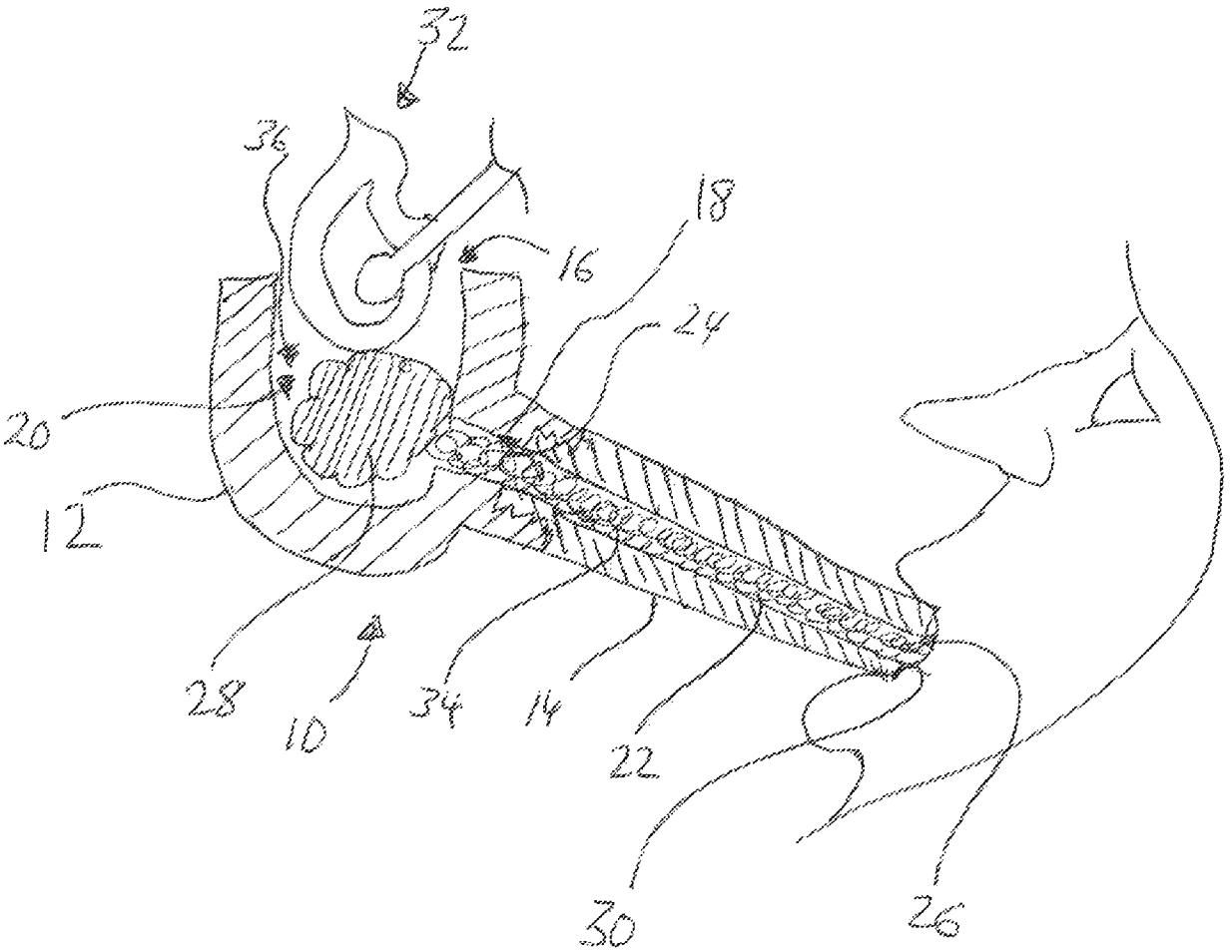
FIG. 1 is substantially an elevation cutaway view of one embodiment of a smoking pipe.
Figure 2:
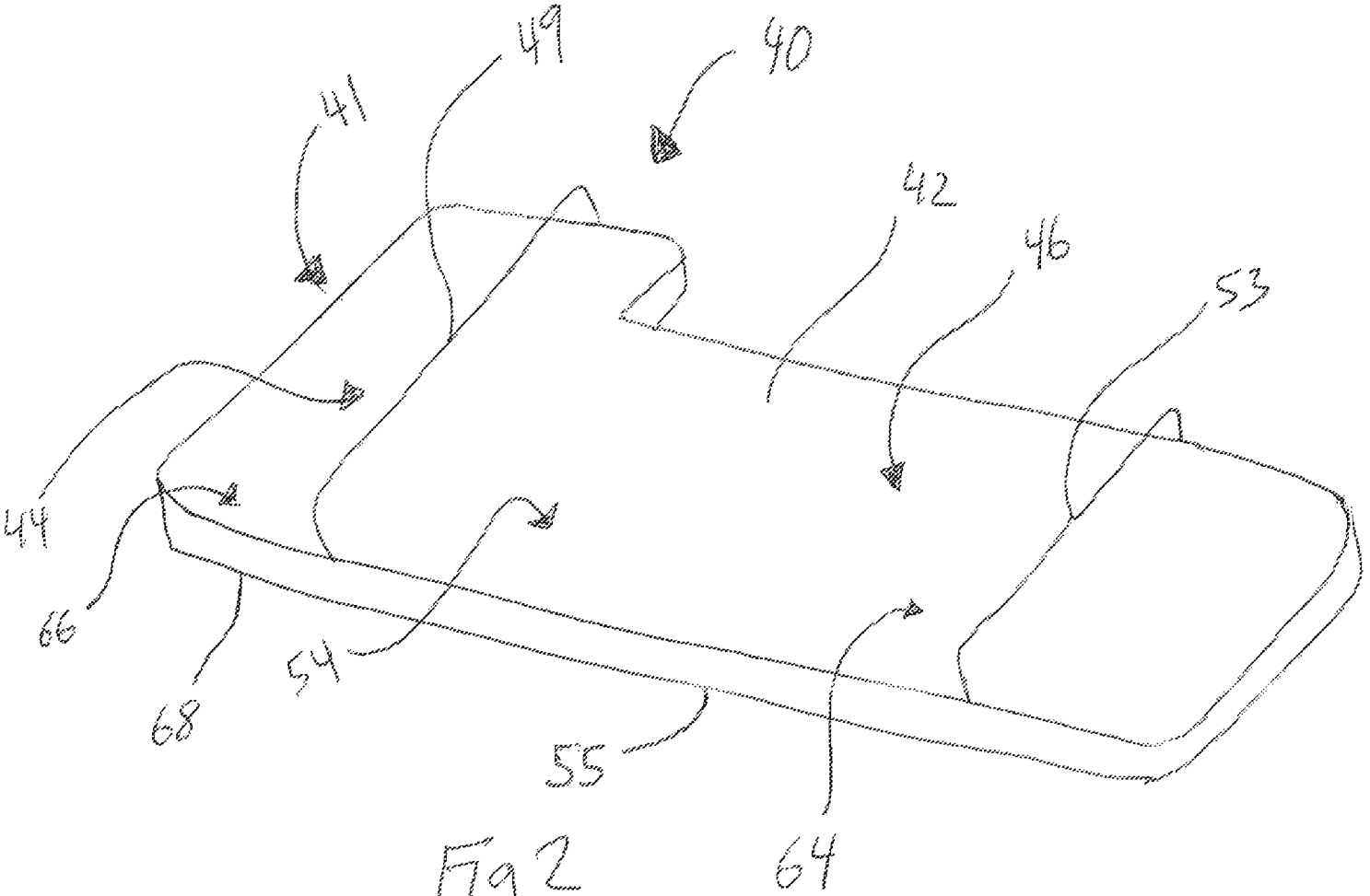
FIG. 2 is substantially a perspective view of one embodiment of the present invention.
Figure 3:
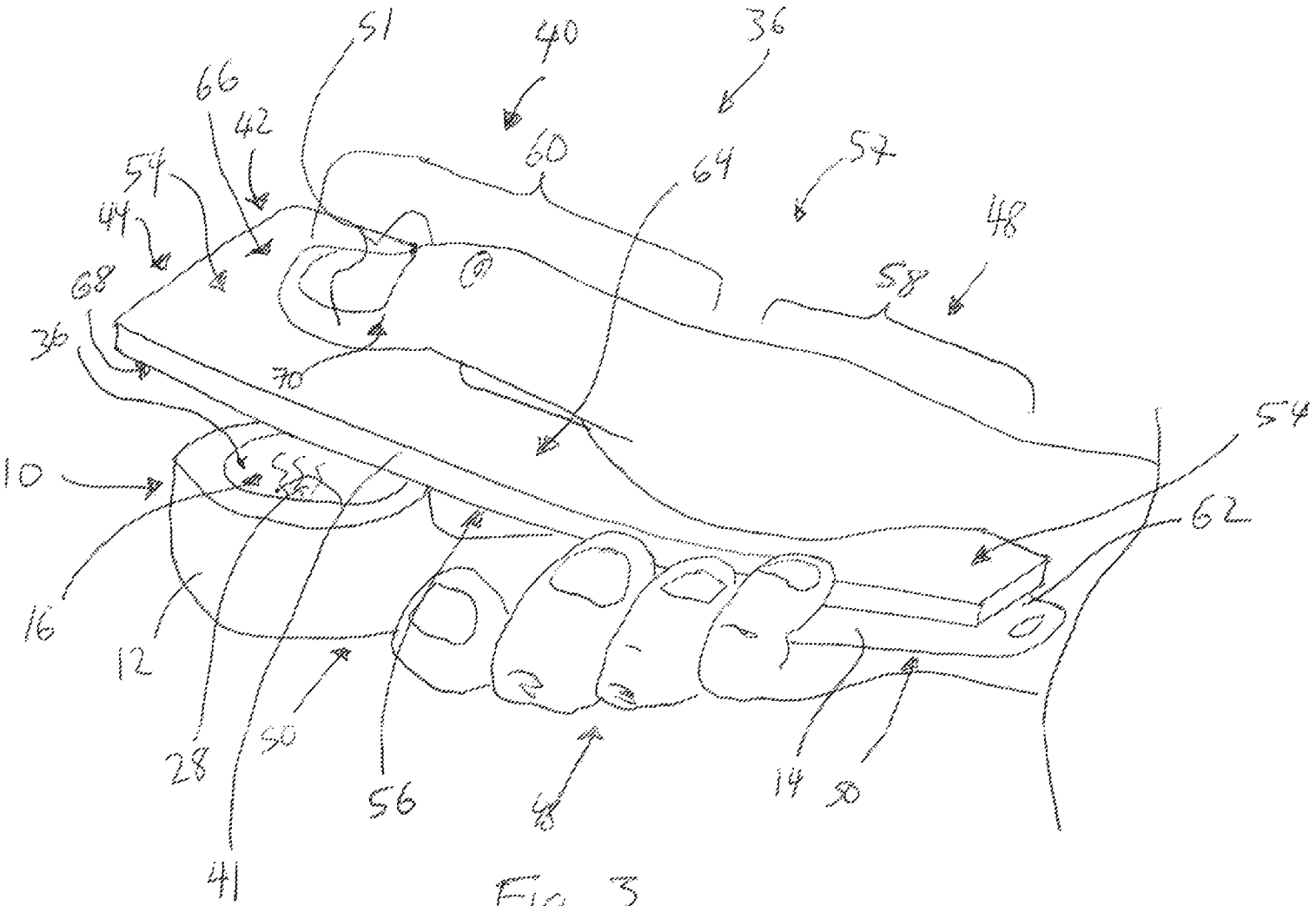
FIG. 3 is substantially a perspective view of one embodiment of the present invention applied to a smoking pipe by an operator's hand, the large bowl aperture not being sealed.
Figure 4:
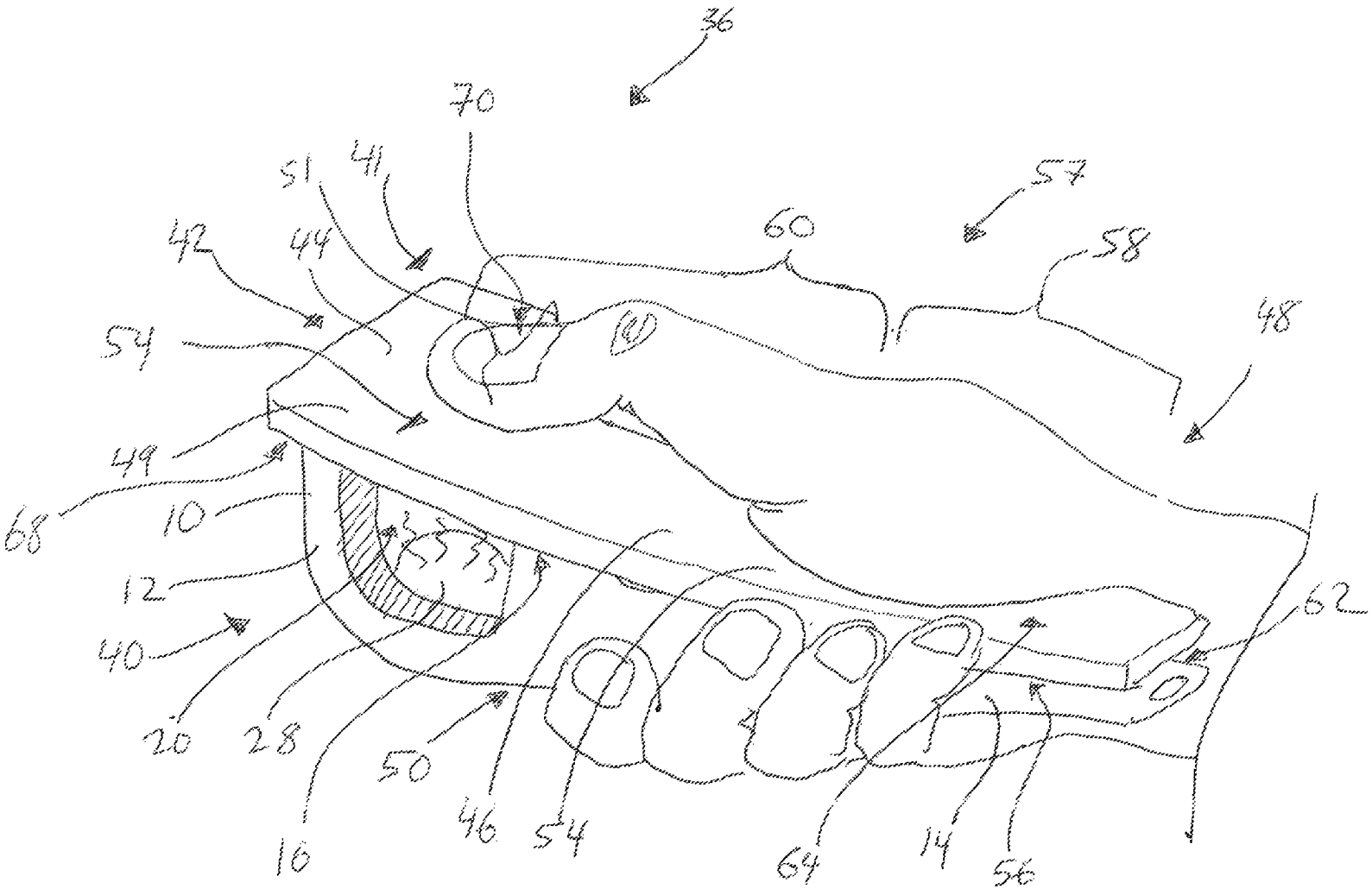
FIG. 4 is substantially a perspective cutaway view of one embodiment of the present invention applied to a smoking pipe by an operator hand, the large bowl aperture being sealed.
Figure 5:
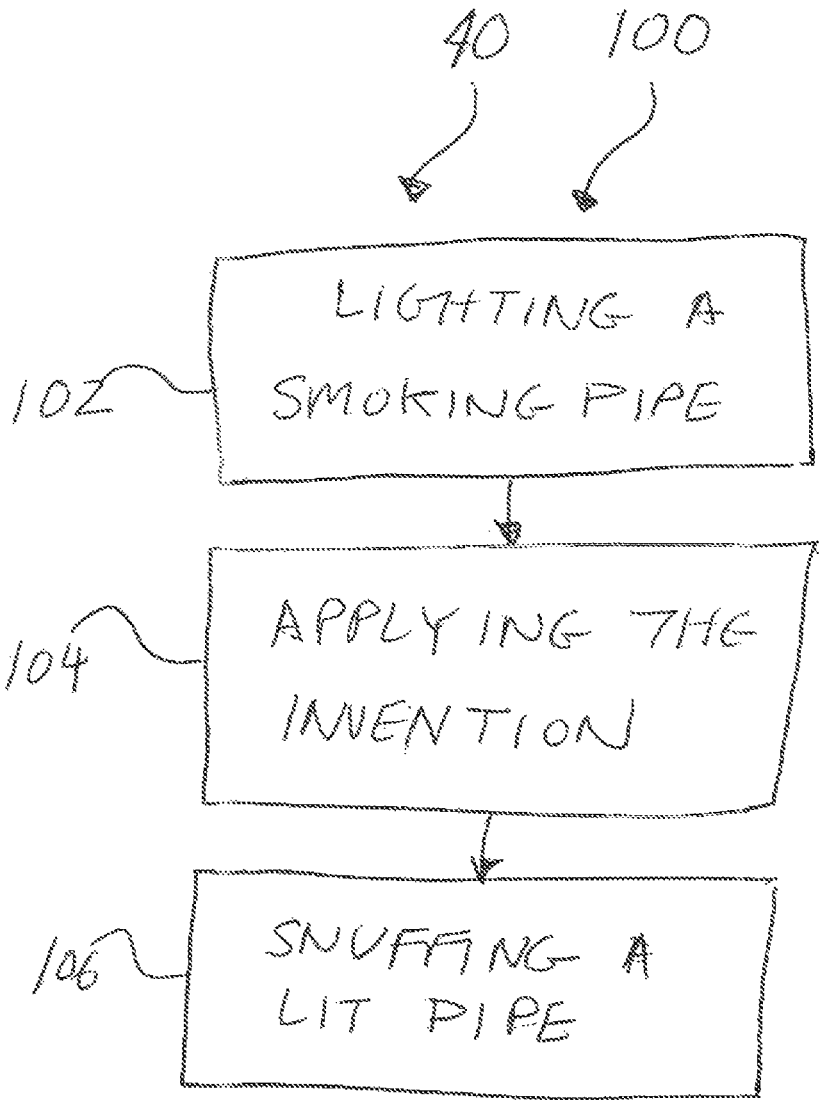
FIG. 5 is a schematic flow chart showing one possible embodiment of method version using the invention.

As substantially shown in FIGS. 2-5, the present invention 40 could comprise a pipe snuffer 41 for a smoking pipe 10 and a method or process for use 100 of same. The present invention 40 could comprise an inverted L-shaped pliable sheet 42 of heat resistant material further denoting a top or foot portion 44 continuously connected to a bottom or leg portion 46, the foot portion width 49 being substantially greater than the leg portion width 53. The length of leg portion 46 being longer than the length of the foot portion 44. In one embodiment, the foot portion's width 49 could wider than the operator's thumb width 51 (e.g., wider that the width thumb's first digit 60 that substantially supports the nail.) In at least one version, the foot portion width 49 could be at least twice as large as the thumb's first digit width 51. In this manner, when the thumb's first digit 60 is substantially placed in the middle of the foot portion's topside 66 during operations, the foot portion 44 could protect the operator's thumb 57 from the emanating heat, such heat may be directed towards the invention underside 55 and to then roll over an edge of the invention 40 way from the operator's hand 48 (more specifically, the thumb 57.)

The pliable sheet material used for the invention 40 could be selected on those qualities such as resisting burning as well as limiting the transmission of heat from burning smoking substance through the invention 40. The flexibility of the said material could allow the invention 40 to held by the operator against a wide variety of smoking pipes having multiple different shapes and sizes.

When an operator wants to use the pipe snuffer 41 to snuff out or otherwise extinguish a smoking pipe's burning smoking substance, the operator could grasp in one hand 48, the invention 40 and the pipe stem 14 of the selected smoking pipe 10. The operator could curl the fingers of the one hand 48 about a bottom side 50 of the pipe stem 14 to substantially place the bottom of the operator's thumb 57 (e.g., the thumb portion comprising thenar region or eminence 58 [e.g., a thumb portion of the palm]) and the first interdigit space 60 (e.g., the thumb portion comprising thumb's first digit 70 supporting the nail and the second thumb digit) over the invention topside 54. The thenar region 58 could be more specifically be substantially placed over the leg portion's topside 64 to substantially press the leg portion's underside 56 down upon the pipe stem's topside 62 to generally removably position the pipe snuffer 41 upon the smoking pipe 10.

The operator could press the thumb's first digit 70 down upon the foot portion's topside 54 to bring the foot portion's bottom side 68 into removable in contact with the pipe bowl 12 to substantially removably seal the large bowl aperture 16. This foot portion 44 could further protect underside of the operator's thumb 57 from any heat generated by the burning smoking substance 28 in the pipe bowl 12 as well as being smudged by any burnt portion (e.g., soot) of the smoking substance 28. This general encapsulation of the hollow bowl interior 20 substantially serves to deprive the burning smoking substance 28 of air 36 (e.g., atmospheric oxygen). This action may substantially extinguish the burning portion of the smoking substance 28 thereby preserving the unburned portion of the smoking substance 28 for later use. The air 36 may remain accessible to the pipe bowl 12 by flowing into the pipe stem 14 other open channel end 26 but generally this action does not provide a sufficient amount of air to support the burning of the smoking substance 28.

Method

The process or method of operating the invention 100 could start with step 102, lighting a smoking pipe. This step could commence with the operator selecting a smoking pipe and the smoking substance to be used. A pinch of the smoking substance could be rolled between the fingers of the operator's hand and inserted into a bottom of the pipe bowl to function as support for a second and larger plug of smoking substance that is placed into the pipe bowl as well. The smoking pipe could be grasped by one hand by the operator to bring the other open pipe stem end into the operator's mouth. The other hand could be used to grasp and operate an open flame source (e.g., a lighter, lit match, and the like.) The flame of the open flame source could then be directed in towards the large bowl aperture and brought proximate to the smoking substance plug. The other open pipe stem end could be brought to the operator's lips allowing the operator to bring a draft of air from the smoking pipe into the operator's mouth. As the initial draft is removed from the pipe (and exhaled by the operator), new air can be sucked into the pipe bowl to substantially bring the flame into further contact with the smoking substance plug, thereby assist with the igniting of same. This ignition protocol could be repeated as needed for the smoking substance plug to be proper ignited and producing a combustion smoke draw with a corresponding draft being sucked into the smoker's mouth. This draft action allows the operator to smoke the smoking pipe as desired. If smoking is no longer desired and there is still amount of smoking substance in the pipe bowl to be consumed, the process 100 could proceed to step 104, applying the invention to the smoking pipe.

In step 104, applying the invention to the smoking pipe, if the smoking pipe has not been put aside, the operator could remove the pipe stem from the operator's mouth to cease the drawing of combustion smoke from the smoking pipe. The operator could then obtain the invention, a pipe snuffer. The smoking pipe could be placed in an operator's hand and the fingers may be substantially curled to removably receive and cradle the pipe stem. The operator then can place the invention above the smoking pipe in a combination that can be held in the one hand. As the operator generally grasps the combination in one hand, the operator's thumb, namely a bottom of the thenar region presses down upon the leg portion's topside to substantially press the leg portion's bottom side onto the pipe stem topside to removably hold the invention in an operational position upon the smoking pipe. At this point, the thumb's first digit underside (e.g., from the first interdigit space) could be placed over the foot portion's topside without generally pressing the foot portion down upon the pipe bowl. In this manner, the first thumb digit could be located upon the middle of the foot portion so that the thumb is kept far enough away from the foot portion's outside edge to keep heat emanating from the ignited smoking substance within the pipe bowl from impinging upon the thumb itself. In addition, the invention material should prevent ignited smoking substance heat transmission though the invention to the thumb itself Upon substantial completion of this step, the process 100 could proceed to step 106, snuffing the smoking pipe.

In step 106, snuffing the smoking pipe, could comprise applying a pressure of the first thumb digit underside or bottom side upon the topside of the foot portion to substantially bring the foot portion's bottom side down upon the large bowl aperture to generally removably seal the large bowl aperture. In this manner, atmospheric air could be blocked from passing into the hollow bowl interior and to substantially cause the ignited smoking substance to extinguish. Generally, the any air otherwise passively moving through the pipe stem channel is insufficient to keep the ignited smoking substance burning by itself. Once the burning smoking stance is extinguished (e.g., waiting several moments after first removably sealing the large bowl aperture), the foot portion may be released from the pipe bowl (e.g., by removing the first thumb digit off the foot portion's topside.) If so desired, the invention in its entirety may be removed from the smoking pipe by removing the thenar eminence from the pipe stem topside. The extinguished smoking substance may be kept in the pipe bowl or be removed to be suitably stored in a suitable container for later re-ignition and use.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A combination of smoking pipe and smoking pipe snuffer comprising:

(A) a smoking pipe having a pipe bowl connected to a pipe stem, the pipe bowl forming a hollow bowl interior continuously connected to a large bowl aperture and pipe stem aperture, the pipe stem further forming a doubled open-ended channel wherein one open end of the pipe stem is received within the pipe stem aperture to continuously connect the double open-ended channel with the hollow bowl interior;

(B) a smoking pipe snuffer having a sheet cut in the shape of an inverted-L to denote a foot portion and a leg portion, the foot portion is configured to be placed over the large bowl aperture to removably seal the large bowl aperture and the leg portion being configured to be removably secured upon the pipe stem;

wherein a portion of an operator's hand removably holds the leg portion upon at least a portion of a topside of the pipe stein;

wherein another portion of the operator's hand removably holds the foot portion down over a top of the pipe bowl to removably seal the large bowl aperture.

2. The combination of claim 1 wherein the portion of the operator's hand is a thenar region.

3. The combination of claim 1 wherein the another portion of the operator's hand is the first thumb digit.

4. The combination of claim 3 wherein a width of the foot portion is wider that a width of the thumb's first digit.

5. The combination of claim 1 wherein a width of the foot portion is greater than a width of the leg portion.

6. The combination of claim 1 wherein a length of the foot portion is less than a length of the leg portion.

7. The combination of claim 1 wherein the hollow bowl interior further contains an amount of ignited smoking substance.

8. The combination of claim 7 wherein when the pipe bowl being removably sealed reduces the amount of air available to the ignited smoking substance.

9. A method of operating a smoking pipe snuffer comprising the following steps:

(A) providing a smoking pipe having a pipe bowl connected to a pipe stem, the pipe bowl forming a hollow bowl interior that continuously connects to a large bowl aperture and pipe stem aperture, the pipe stem further forming a doubled open-ended channel wherein one open end of the pipe stem is received within the pipe stem aperture to continuously connect the double open-ended channel with the hollow bowl interior;

(B) providing a smoking pipe snuffer having a an inverted-L shaped sheet to denote a foot portion continuously connected to a leg portion, the foot portion is further configured to be placed over the large bowl aperture to removably seal the large bowl aperture and the leg portion is further configured to be removably secured upon the pipe stem;

(C) grasping the pipe stem with curled fingers of one hand of an operator;

(D) removably holding the leg portion between a topside of the pipe stem and a bottom of a thumb of the one hand; and (E) removably sealing the large bowl aperture with the foot portion.

10. The method of claim 9 wherein the holding the leg portion further comprises a step of contacting a thenar region of the thumb with the leg portion to removably press the leg portion onto the topside of the pipe stem.

11. The method of claim 9 wherein the removably sealing the large bowl aperture further comprises a step of removably pressing an underside of a first digit of the thumb down upon the foot portion to bring the foot portion in contact with the pipe bowl.

12. The method of claim 9 further comprising a step of placing an amount of smoking material into the hollow bowl interior and igniting at least a portion of the amount of smoking material.

13. The method of claim 12 wherein the removably sealing the large bowl aperture with the foot portion further extinguishes the ignited smoking material.

* * * * *